US006048585A

United States Patent [19]

Martyak et al.

[11] Patent Number: 6,048,585

[45] Date of Patent: Apr. 11, 2000

[54] REMOVAL OF ORTHOPHOSPHITE IONS FROM ELECTROLESS NICKEL PLATING BATHS

[75] Inventors: Nicholas M. Martyak, Doylestown, Pa.; John E. McCaskie, Berlin, Germany

[73] Assignee: Atotech Deutschland GmbH, Berlin, Germany

[21] Appl. No.: 09/101,145

[22] PCT Filed: Nov. 13, 1997

[86] PCT No.: PCT/US97/20781

§ 371 Date: Jan. 25, 1999

§ 102(e) Date: Jan. 25, 1999

[87] PCT Pub. No.: WO98/21381

PCT Pub. Date: May 22, 1998

Related U.S. Application Data

[60] Provisional application No. 60/030,877, Nov. 14, 1996.

[51] Int. Cl.[7] ..... B05D 1/18; B22R 7/00

[52] U.S. Cl. ..... 427/443.1; 427/98; 427/305; 427/438; 106/1.22; 106/1.29

[58] Field of Search ..... 427/98, 305, 438, 427/443.1; 106/1.22, 1.27

[56] References Cited

U.S. PATENT DOCUMENTS

| | | | |
|---|---|---|---|
| 5,221,328 | 6/1993 | Bishop et al. | 106/1.23 |
| 5,258,061 | 11/1993 | Martyak et al. | 106/1.22 |
| 5,277,817 | 1/1994 | Martyak et al. | 210/634 |
| 5,338,342 | 8/1994 | Mallory, Jr. | 106/1.22 |
| 5,944,879 | 8/1999 | Martyak | 106/1.22 |

*Primary Examiner*—Brian K. Talbot
*Attorney, Agent, or Firm*—Stanley A. Marcus; Gilbert W. Rudman

[57] ABSTRACT

Orthophosphite ions produced by oxidation of hypophosphite in an electroless nickel plating bath can be removed by precipitation with an alkali metal or alkaline earth metal cation such as calcium. In order to avoid the precipitation of calcium sulfate and the generation of large amounts of particulates in the bath, nickel sulfate can be replaced by a nickel salt of an alkylsulfonic acid or hypophosphorous acid, whose anion forms a soluble salt with an alkali metal or alkaline earth metal cation.

16 Claims, No Drawings

REMOVAL OF ORTHOPHOSPHITE IONS FROM ELECTROLESS NICKEL PLATING BATHS

This Application is a Provisional Application of U.S. Ser. No. 60/030,877, filed Nov. 14, 1996.

SUMMARY OF THE INVENTION

This invention relates to electroless nickel plating baths which employ a hypophosphite reducing agent. More particularly, this invention relates to improved electroless nickel plating baths which are made long running by(a) controlling and removing undesirable phosphite anions produced as a by-product during the electroless plating reaction (b) minimizing the formation of sludge in the bath and (c) minimizing the presence and effect of undesirable ions. The invention also relates to nickel deposits having low porosity and low compressive stress.

BACKGROUND OF THE INVENTION

Electroless nickel plating is a widely utilized plating process which provides a continuous deposit of a nickel metal coating on metallic or non metallic substrates without the need for an external electric plating current. Such a process is described generally as a controlled autocatalytic chemical reduction process for depositing the desired nickel metal and is simply achieved by immersion of the desired substrate into an aqueous plating solution under appropriate electroless plating conditions.

In conducting electroless nickel plating, particularly from a bath which utilizes a hypophosphite as the reducing agent, the bath basically contains a source of nickel cations such as nickel sulfate and a hypophosphite reducing agent such as sodium hypophosphite. The deposition reaction takes place in the bath and generally involves the reduction of a nickel cation to form a nickel metal alloy as a deposit on the desired substrate surface. The reduction reaction is generally represented by the following equation:

$$3H_2PO_2^{-}+Ni^{+2}\rightarrow 3/2H_2\uparrow+H^{+}+2HPO_3^{-2}+P+Ni^{o}$$

It is seen that the electroless reaction produces phosphite ions, hydrogen ions and hydrogen gas; it also produces a counterion of the nickel source compound used, typically a sulfate, $SO_4^{-2}$ The nickel and hypophosphite are consumed in the reaction and they, accordingly, must be frequently replenished. In addition, as the hydrogen ions produced in the reaction accumulate they result in a lowering of the pH from the optimum plating ranges. In order to maintain the desired pH range, and in usual practice, a pH adjustor such as a hydroxide or carbonate especially of an alkali metal such as sodium is added frequently during the plating reaction. This significantly increases the monovalent sodium cation concentration of the electroless plating bath.

Additionally, nickel usually in the form of nickel sulfate is added to maintain the optimum nickel concentration thereby increasing the concentration of undesirable sulfate anion. As the reaction continues, the by-products and bath conditions created thereby present problems which adversely affect the desired plating process.

These problems are the buildup of the phosphite anion produced from the oxidation of the hypophosphite reducing agent, the buildup of the anion of the nickel salt employed, typically sulfate, as well as the increased concentration of extraneous cations, especially sodium. This build-up or increase in the concentration of such anions and cations as they accumulate in the bath produces a deleterious effect on the plating reaction and also adversely affects the quality of the plating deposited on the substrate. In particular, the phosphite anion causes an increase in stress of the nickel deposit and shifts the stress from compressive to tensile; this increased stress reduces the corrosion resistance of the nickel deposit. Also, the accumulation of ionic species in the bath degrades the quality of the nickel deposit and makes it unacceptable for such high-level applications as hard discs for computers, as well as CD-ROM and other optical disc storage. Further, the phosphite anions adversely affect the bath by often reacting with and precipitating the nickel cation as nickel phosphite; this slows the rate of deposition of nickel, prevents long lasting baths and results in the bath becoming unsatisfactory and thus terminated at low levels of metal turnover, i.e., the number of times that the original nickel source is replenished. Thus the accumulation of phosphite as well as added alkali metal cations and sulfates prevents the long-term and economical use of the expensive plating solutions and adversely affects the nickel deposit.

These deleterious factors and particularly the build-up of phosphite and sulfate anions have been addressed through use of a variety of treatment methods. These treatments are illustrated in the prior art in such references as G. G. Gawrilov, Chemical Nickel Plating, Portcullis Press, England, 1974; Wei-chi Ying and Robert R. Bonk, Metal Finishing, 85, 23–31, (Dec. 1987); E. W. Anderson and W. A. Neff, Plating and Surface Finishing, 79, 18–26, (March 1992); and K. Parker, Plating and Surface Finishing, 67, 48–52, (March 1980).

Typically these prior art methods have involved treatment of the plating bath solution with calcium or magnesium salts, ferric chloride and anion exchange resins. The use for example of calcium and magnesium results in the generation of large amounts of sludge in the bath caused by the insolubility of the phosphite and sulfate salts of the alkaline earth metals. Ferric chloride addition lowers the pH and introduces iron to the bath.

Mallory, in U.S. Pat. No. 5,338,342 removes by-product phosphite anions by precipitation with lithium hydroxide.

DESCRIPTION OF THE INVENTION

It has now been discovered, however, that the by-product phosphite anions may be readily removed from the plating bath solution without generating large amounts of sludge and without the disadvantages of the prior methods, while achieving a bath free of added cations, such as sodium, frequently introduced through the hypophosphite reducing agent or pH controls. This discovery allows long running nickel bath operations while maintaining high plating rates.

Further, in operation it has been found desirable to keep the stress of the nickel alloy deposit low because at high stress levels the corrosion resistance of the nickel alloy deposit declines. The level of orthophosphite in the bath is an important determinant of the stress of the deposit; as seen from the Examples, the stress of the deposit changes from compressive to tensile when the orthophosphite (phosphite) level of the electroless nickel plating bath increases.

The foregoing results can be achieved by the addition of an alkali or alkaline earth metal cation which, in the electroless nickel plating bath, forms an insoluble phosphite which can readily be removed from the bath. It is preferred that the alkali or alkaline earth metal cation be added to the bath when a substrate to be plated is not within the bath.

This treatment can be further enhanced by incorporating the alkali or alkaline earth metal cation in the form of a hypophosphite salt, which favors formation of the insoluble phosphite salt without causing the build-up of extraneous cations in the system. This process allows the almost immediate removal of orthophosphite as it is formed, permits formation of low-stress nickel alloy deposits, avoids the build-up of extraneous cations and allows a continued high rate of plating even after as many as 30 or more metal turnovers.

As has been previously mentioned the sulfate anion tends to form insoluble salts with the same alkali metal and alkaline earth metal cations that will precipitate orthophosphite from the bath. This causes the formation of a large amount of particulates in the bath; the volume of sludge makes it difficult to operate the electroless nickel bath for more than about 7 metal turnovers. Therefore, in a preferred embodiment of the invention the nickel cation is introduced into the system as the salt of an anion that forms a soluble salt with the cation used to precipitate the orthophosphite.

DETAILED DESCRIPTION

In one aspect this invention relates to novel electroless nickel plating baths and to a process for operating such baths.

In another aspect, the invention relates to a process for the removal of phosphite anion and the prevention of the accumulation thereof in an electroless nickel plating bath.

In yet another aspect, this invention relates to a process for operating an electroless nickel plating bath which minimizes the formation of insoluble materials in the bath.

In yet another aspect, this invention relates to the use in an electroless nickel plating bath of the nickel salt of an anion that forms a soluble salt with the cation used to remove the orthophosphite anion from the bath. In an embodiment of this aspect, the invention relates to smooth, low porosity electroless nickel deposits.

In yet another aspect, this invention relates to a continuous process for operating electroless nickel baths. In one embodiment, the invention relates to the makeup solutions used to replenish nickel and hypophosphite. These and other aspects of the invention will be apparent from the following detailed description.

The invention which is related to electroless nickel baths comprises hypophosphite ion, nickel ion, alkali metal or alkaline earth metal ion, an ion derived from an alkyl sulfonic acid, and optionally, buffers, stabilizers, complexing agents, chelating agents, accelerators, inhibitors or brighteners.

In one embodiment the alkali metal or alkaline earth metal compound is added to the bath during the electroless nickel reaction to form the corresponding insoluble alkali metal or alkaline earth metal phosphite; the insoluble phosphite is removed from the bath using appropriate filtration and/or separation procedures.

In another embodiment a less than stoichiometric (compared to the orthophosphite) amount of an alkali metal or alkaline earth metal compound is added to the bath after the electroless nickel reaction and the removal of any substrate to be deposited with nickel; the alkali metal or alkaline earth metal compound forms an insoluble phosphite; the insoluble phosphite is removed from the bath using appropriate filtration and/or separation procedures.

In either way the orthophosphite content of the bath is minimized. The alkali metal or alkaline earth metal compound is selected to be soluble in the bath but to form an insoluble orthophosphite salt. By way of illustration, the alkali metal and alkaline earth metal compounds can be the oxides, hydroxides and carbonates of lithium, potassium, magnesium, barium and/or calcium. In order to avoid introducing extraneous ions into the bath, it is preferred that the alkali metal or alkaline earth metal cation be introduced as the hypophosphite salt and in the preferred embodiment calcium hypophosphite is added to the bath; the calcium from the hypophosphite is available to react with the orthophosphite as it forms, there are no undesired ions introduced into the bath and the stress of the nickel alloy deposit is minimized.

Alternatively, in another preferred embodiment, the alkali metal or alkaline earth metal cation can be added partly or completely as the salt of an alkyl monosulfonic acid or alkyl polysulfonic acid. These sulfonic acids are described in detail below in connection with the nickel salt. For example, part or all of the calcium hypophosphite can be replaced by calcium methanesulfonate, which is soluble. In such case the hypophosphite can be supplied as hypophosphorous acid. Further, when one chooses to use hypophosphorous acid, the pH can be controlled by addition of an alkaline earth metal carbonate to precipitate out the orthophosphite and adjust pH. Here too, the stress of the nickel alloy deposit is minimized.

In a preferred embodiment of one aspect of this invention, the nickel compound is a water soluble nickel salt of a counterion that forms a soluble salt with the cation used to precipitate the orthophosphite from the bath.

As has been described, use of nickel sulfate in a bath where an alkaline earth metal is used to remove the orthophosphite results in the formation of an alkaline earth metal sulfate; these are insoluble and create an undesirable sludge in the bath.

It has been found that introduction of the nickel cation as the salt of an anion that forms a soluble alkali or alkaline earth metal salt reduces the buildup of sludge and allows for the continuous removal of orthophosphite and the continuous operation of the bath.

Although the nickel can be introduced as the salt of an acid such as hypophosphorous acid, nitric acid, acetic acid, sulfamic acid, hydrochloric acid, lactic acid, formic acid, propionic acid, trichloroacetic acid, trifluoroacetic acid, gycolic acid, aspartic acid, pyruvic acid or mixtures thereof, in practice these salts are not widely used, either because (a) they cause high stress deposits, (b) they decompose at the preferred operating temperatures of the baths or (c)their solubility in water does not allow their use for practical and economical industrial application.

In one preferred embodiment the nickel ion is introduced as the salt of an alkyl sulfonic acid. Nickel salts of methanesulfonic acid are particularly preferred and the entire nickel ion content of the electroless nickel plating bath can be supplied in the form of the alkyl sulfonic acid salt.

In another embodiment, the nickel ions are introduced as the mixed salt of an acid such as hypophosphorous acid, acetic acid, sulfamic acid, lactic acid, formic acid, or propionic acid and an alkyl sulfonic acid of the above formula. By addition of the alkylsulfonic acid, the solubility of the nickel salts of, for example, hypophosphorous acid can be increased significantly.

In conventional electroless nickel baths the operating nickel ion concentration is typically from about 1 to about 18 grams per liter (g/l) with concentrations of from about 3 to about 9 g/l being preferred. Stated differently, the concentration of nickel cation will be in the range of from 0.02 to about 0.3 moles per liter, preferably in the range of from about 0.05 to about 0.15 moles per liter.

The ions derived from the alkyl sulfonic acid are of formula:

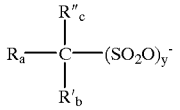

where:

a, b and c each independently is an integer from 1 to 3;

y is an integer from 1 to 3;

R" is hydrogen, or lower alkyl that is unsubstituted or substituted by oxygen, Cl, F, Br or I, $CF_3$ or —$SO_2OH$;

R and R' each independently is hydrogen, Cl, F, Br, I; $CF_3$ or lower alkyl that is unsubstituted or substituted by oxygen, Cl, F, Br, I, $CF_3$ or —$SO_2OH$;

and the sum of a+b+c+y=4.

Representative sulfonic acids include the alkyl monosulfonic acids such as methanesulfonic, ethanesulfonic and propanesulfonic acids and the alkyl polysulfonic acids such as methanedisulfonic acid, monochloromethanedisulfonic acid, dichloromethanedisulfonic acid, 1,1-ethanedisulfonic acid, 2-chloro-1,1-ethanedisulfonic acid, 1,2-dichloro-1,1-ethanedisulfonic acid, 1,1-propanedisulfonic acid, 3-chloro-1,1-propanedisulfonic acid, 1,2-ethylene disulfonic acid and 1,3-propylene disulfonic acid.

Because of availability, the sulfonic acids of choice are methanesulfonic and methanedisulfonic acids.

The hypophosphite reducing agent employed in the baths according to this invention may be any of those conventionally used for electroless nickel plating such as sodium hypophosphite.

However, in a particularly preferred embodiment according to the present invention, the hypophosphite reducing agent employed in the reaction is a nickel salt or an alkali metal or alkaline earth metal salt such as calcium hypophosphite which further serves to minimize the extraneous introduction of sodium cations into the reaction bath. The use of calcium hypophosphite further provides an additional source of calcium into the bath for facilitating the formation of the desired calcium phosphite.

The amount of the reducing agent employed in the plating bath is at least sufficient to stoichiometrically reduce the nickel cation in the electroless nickel reaction to free nickel metal and such concentration is usually within the range of from about 0.05 to about 1.0 moles per liter. Stated differently, the hypophosphite reducing ions are introduced to provide a hypophosphite ion concentration of about 2 up to about 40 g/l, preferably about 12 to 25 g/l with a concentration of about 15 to about 20 g/1 being optimum. The specific concentration of the nickel ions and hypophosphite ions employed will vary depending upon the relative concentration of these two constituents in the bath, the particular operating conditions of the bath and the types and concentrations of other bath components present. As a conventional practice the reducing agent will be replenished during the reaction.

While the foregoing discussion contemplates forming a bath from the start, it is possible to rapidly convert an existing nickel sulfate bath. This is accomplished by incorporating an alkaline earth metal salt of an alkyl sulfonic acid (e.g., calcium methanesulfonate) in an amount to precipitate the alkaline earth metal sulfate and leave the alkyl sulfonate as the nickel counter ion. Thereafter, calcium hypophosphite is slowly added to precipitate the orthophosphite.

The baths according to this invention may contain in addition to the sources of nickel and hypophosphite other conventional bath additives such as buffering, complexing, chelating agents, as well as accelerators, stabilizers, inhibitors and brighteners.

The temperature employed for the plating bath is in part a function of the desired rate of plating as well as the composition of the bath. Typically the temperature is within the conventional ranges of from about 25° C. to atmospheric boiling at 100° C., although in a preferred embodiment the particular plating solution temperature is usually about 90° C. and within the range of from about 30° to 95° C.

The electroless nickel plating baths can be operated over a broad pH range including the acid side and the alkaline side at a pH of from about 4 up to about 10. For an acidic bath, the pH can generally range from about 4 up to about 7 with a pH of about 4.3 to about 5.2 being preferred. For an alkaline bath, the pH can range from about 7 up to about 10 with a pH range of from about 8 to about 9 being preferred. Since the bath has a tendency to become more acidic during its operation due to the formation of hydrogen ions, the pH is periodically or continuously adjusted by adding bath soluble and compatible alkaline substances such as alkali metal and ammonium hydroxides, carbonates and bicarbonates. Stability of the operating pH can also be provided by the addition of various buffer compounds such as acetic acid, propionic acid, boric acid or the like in amounts up to about 30 g/l with amounts of about 4 to about 12 g/l being typical.

In practicing the process of this invention the specific mode or procedure employed is dependent upon whether the stabilization is performed as a batch or as a continuous process.

In general, however, when the conventional plating operation has been continued under appropriate electroless nickel plating conditions, the plating is terminated by withdrawal of the substrate being plated. The point of termination or duration of the plating will depend upon several factors such as the quantity of nickel metal desired for the deposit, plating rate, temperature and bath composition. It is preferred according to one embodiment of this invention to add an alkali metal or alkaline earth metal cation such as calcium to control the concentration of orthophosphite after the plating is terminated.

Removal of the insoluble alkali metal or alkaline earth metal phosphite formed may be achieved using appropriate separational techniques such as decanting, centrifuging or filtration. Filtration, however, because of the ease of operation is a preferred procedure and may be performed by passing the plating solution through an appropriate filter medium having a pore size approximate to entrap the insolubilized phosphite salt. Filters having capture size in the range below about 5 microns are suitable for such purpose.

A particularly preferred and advantageous feature of the present invention permits the bath to be operated on a continuous basis. In conducting a continuous process for the electroless nickel plating baths of this invention, the plating bath containing the desired bath components, but preferably with no more than very low levels of the alkali metal or alkaline bath metal cations, is maintained in a suitable plating vessel or bath zone such as a glass or plastic tank. The plating is allowed to proceed upon a suitable substrate under electroless nickel plating conditions. A stream portion of the bath is then continuously withdrawn from the plating vessel and passed by appropriate pumping means to a separation zone such as a vessel or tank. The rate of withdrawal from the plating vessel may be controlled by monitoring the phosphite concentration buildup and the withdrawal rate increased or decreased to maintain the desired phosphite concentration generally below about 0.4 moles per liter. The concentration of phosphite is controlled by the addition of alkali metal or alkaline earth metal cations to the separation zone to form suspended insoluble alkali metal or alkaline earth metal phosphite which is then passed to a removal zone where the insoluble phosphite is separated from the bath solution. Such removal zone may appropriately be a filter of conventional design having the ability to separate particle sizes below about 0.5 microns on a continuous basis. The stream portion of the bath is then continuously returned to the bath zone to continuously add back to the bath solution replenished bath solution that is substantially free of phosphite anions.

The continuous process may be thus operated over long periods of time with the conventional replenishment of the sources of the nickel and hypophosphite plating materials to achieve a bath capable of long plating runs.

The improvements described above had reference to the operation of a bath formulated from the start with the necessary ingredients. However, one can use the materials described herein to replenish a standard nickel sulfate bath and realize the benefits, albeit slowly and over a period of time. Thus, nickel in a standard bath can be replenished with the nickel salt of an alkylsulfonic acid; the alkylsulfonic acid is compatible with the other ingredients in the bath. At the same time the hypophosphite concentration can be replenished with calcium hypophosphite.

The following Examples are offered to illustrate the electroless nickel plating baths of this invention and the modes of carrying out such invention:

EXAMPLE 1

The effects of the addition of calcium ion to remove phosphite ion in various electroless nickel bath solution compositions ($NiSO_4$ vs NiMSA vs NiHypo) on the properties of the coatings was studied.

Electroless nickel solutions were prepared, when possible by using commercially available complexor and/or buffer packages, such as those marketed by Atotech USA, Inc., Rock Hill, S.C. (sold under the trade name Nichem), MacDermid, Waterbury, Conn. (sold under the trade name Niklad systems), Shipley, Marlborough, Mass. (sold under the tradenames Duraposit, Niculloy systems), Fidelity, Newark, N.J. (sold under the tradename Fidelity EN systems) and Ethone, New Haven, Conn. (sold under the tradename Enplate systems). In the examples Nichem 2500 products were used.

The electroless nickel solutions were formulated as follows:

Solution 1A: Based on Nickel Sulfate

A commercially available make-up and replenishment solutions from Atotech USA, Inc. sold under the trade name Nichem 2500 were used. The nickel sulfate was the Nichem 2500 A solution; from this stock solution, 80 ml/l was added on make-up. Nichem 2500 B was added at 150 ml/l and the final volume was 1000 ml. During plating, the concentration of the components was maintained using 80 ml/l Nichem 2500 A and 80 ml/l Nichem 2500 C per metal turnover.

Solution 1B: Based on Nickel Methanesulfonate

A stock $Ni(MSA)_2$ solution was prepared by dissolving 150 g/l $NiCO_3$ into 360 ml/l of 70% MSA. To this solution was added 0.031 g/l $Cd(OEs)_2$ and 0.025 g/l thiourea. The same Nichem 2500 B and C components were used for makeup (15% Nichem 2500 B) and replenishment (8% Nichem 2500 C), respectively.

Solution 1C: Based on Nickel Hypophosphite

A stock $Ni(H_2PO_2)_2$ solution was prepared by dissolving 70 gms nickel carbonate into 156 ml of a 50% hypophosphorus acid solution followed by dilution to one liter. The final concentration of $Ni^{+2}$ was 35 g/l and $H_2PO_2^-$ was 78 g/l. To this solution was added 0.014 g/l cadmium ethanesulfonate, $Cd(OEs)_2$, and 0.009 g/l thiourea. A total of 171 ml/l of this stock solution was added on make-up of the electroless nickel solution. By adding the $Ni^{+2}$ as $Ni(H_2PO_2)_2$, 13.6 g/l of $H_2PO_2^-$ (22.5 g/l as $NaH_2PO_2.H_2O$) is also added from this A component. Therefore, it was necessary to modify the B component to compensate for the hypophosphite addition from the A component. The thiourea and $Cd^{+2}$ concentrations were also modified to account for the added volume of the A component during make-up and replenishment.

A Component B for the Hypophosphite bath was produced to be similar to NICHEM 2500B. It had the following composition:

$NaH_2PO_2.H_2O$—50 g/l

Lactic Acid—200 ml/l

Acetic Acid—100 ml/l

Propionic Acid—15 ml/l

Glycine—35 g/l

NaOH—125 g/l $Pb(NO_3)_2$—15 ppm

A Component C (for replenishment)for the Hypophosphite bath was produced to be similar to NICHEM 2500C. It had the following composition:

$NaH_2PO_2.H_2O$—95 g/l

Lactic Acid—5 ml/l

Acetic Acid—2.5 ml/l

Propionic Acid—1 ml/l

Glycine—2 g/l

NaOH—30 g/l $NH_3$—3 ml $Pb(NO_3)_2$—150 ppm $Cd(OEs)_2$—150 ppm

The volumes of the B and C components remained the same, 15% and 8% v/v, respectively as in Solutions 1A and 1B.

Results of the Addition of Ca+2 to Each of the Solutions

A-Effect of Solution Age (Metal Turnover) on Deposition Rate

The rate was determined from weighing low carbon steel coupons before and after plating. The weight of the electroless nickel coating was divided by the plated surface area to give grams of nickel-phosphorus coating per centimeter square ($g/cm^2$). This value was then divided by the density of this coating, 7.9 $g/cm^3$, to give a thickness in centimeters which was then converted to microns.

All three coatings were smooth and bright up to three MTOs. In general, the surface morphology of all three deposits were similar as characterized using scanning electron microscopy. At three MTO, small surface nodules are seen in the surface. These nodules are about 2–5 $\mu$m in size. At about 4 MTO, the small surface nodules are increasing in size to about 5–10 $\mu$m. Several small nodules are often seen lying adjacent to or on top of existing surface nodules. At 5 MTO, large nodules are still dispersed throughout the surface but numerous smaller nodules, 1–3 $\mu$m, completely cover the surface of the EN deposit. At 6 MTO, the smaller nodules grew to about 2–6 $\mu$m. Many smaller nodules are again seen growing on existing nodules. These roundedmounds are surround by crevices. At 7 MTO, the crevices surrounding the nodules appeared to have deepened. Small cracks are started to propagate throughout the surface of the EN deposit. At 8 MTO, large nodules with smaller superimposed nodular structures cover the surface. The crevices were deep.

After 8 MTOs and analysis for orthophosphite, $H_2PO_3^-$, a stoichiometric amount of $Ca^{+2}$ was added to the solution as $Ca(MSA)_2$ (1.5 M $Ca^{+2}$ and 3.0 M methanesulfonate). Afterwards the precipitate, $Ca(H_2PO_3)_2$, was removed by filtration.

After the $Ca^{+2}$ treatment, these nodules present after 8 MTO either disappear completely or were significantly reduced in size and density and there was an increase in deposition rate except for the nickel sulfate system. This is due to incomplete removal of the $H_2PO_3^-$ because some of the calcium ion was reacting with the sulfate ion.

TABLE 1

Effect of Solution Age (Metal Turnover) on Deposition Rate

| | Deposition Rate (microns per hour) | | |
|---|---|---|---|
| MTO | IA $NiSO_4$ | 1B NiMSA | 1C NiHypo |
| 0 | 20.3 | 20.7 | 19.3 |
| 1 | 20.7 | 18.8 | 21.4 |
| 2 | 19.3 | 18.2 | 20.5 |
| 3 | 19.9 | 18.1 | 19.3 |
| 4 | 18.8 | 17.4 | 18.9 |
| 5 | 18.7 | 18.1 | 18.9 |
| 6 | 17.9 | 17.7 | 19.6 |
| 7 | 18.2 | 16.5 | 17.9 |
| 8 | 17.2 | 16.2 | 18.5 |
| 9 | 17.1 | 18.5 | 19.9 |
| 10 | 16.2 | 18.7 | 19.2 |

B—Effect of Solution Age (Metal Turnover) on Stress in Nickel Coating

The internal stress was measured using stress strips obtained from Specialty Testing and Development Co, Fairfield, Pa. The stress tabs were cleaned by immersion in a mildly alkaline solution at 50° C. for fifteen seconds. After water rinses, the tabs were dried and weighed. After plating the stress strips were re-weighed and the weigh of the coating was calculated. The stress was then determined from the strip constant, weigh gain and density of the coating as described in the application bulletin from Specialty Testing and Development Co.

Initially, the stress in all deposits was compressive which increased in magnitude through 2 MTOs. Between 2–7 MTOs, the stress gradually increased in all the coating but remained compressive until about 7 MTO.

After 8MTOs, when the stress was tensile, and after analysis for orthophosphite, $H_2PO_3^-$, a stoichiometric amount of $Ca^{+2}$ as $Ca(MSA)_2$, was added to the solution and the precipitate was removed by filtration. Complete removal of $H_2PO_3^-$ in the NiMSA and NiHypo solutions caused the stress to revert back from tensile to compressive. The $NiSO_4$ solution still exhibited a tensile stress because of the difficulty of removing all the $H_2PO_3^-$. Note the stress after $H_2PO_3^-$ removal is about the same as in the original solutions.

TABLE 2

Effect of Solution Age (Metal Turnover) on Stress in Nickel Coating

| | Internal Stress (PSI) | | |
|---|---|---|---|
| MTO | 1A $NiSO_4$ | 1B NiMSA | 1C NiHypo |
| 0 | −10500 | −5097 | −7300 |
| 1 | −9000 | −12917 | −8200 |
| 2 | −9250 | −13800 | −8500 |
| 3 | −8700 | −8400 | −7200 |
| 4 | −8200 | −7500 | −5000 |
| 5 | −5400 | −3200 | −3800 |
| 6 | −2800 | −1050 | −2100 |
| 7 | −1100 | +550 | −150 |
| 8 | +850 | +1025 | +2000 |
| 9 | +1700 | −8345 | −5100 |
| 10 | +3200 | −7450 | −6100 |

EXAMPLE 2

No Build-Up of Extraneous Ions Such as Sodium, Sulfate and Methanesulfonate.

The following solution compositions were prepared:

| | Solution 2A | Solution 2B | Solution 2C | Solution 2D |
|---|---|---|---|---|
| $NiSO_4.6H_2O$ g/l | 27 | — | — | — |
| $Ni(MSA).XH_2O$ g/l | — | 27 | — | — |
| $Ni(H_2PO_2)$ g/l | — | — | 19.2 | 19.2 |
| MSA ml/l | — | — | — | 14.4 |
| as $Ni^{+2}$ g/l | 6 | 6 | 6 | 6 |
| Lactic Acid ml/l | 30 | 30 | 30 | 30 |
| Acetic Acid ml/l | 15 | 15 | 15 | 15 |
| Propionic Acid ml/l | 5 | 5 | 5 | 5 |
| $H_3PO_2$ ml/l | 44 | 44 | 17.4 | 17.4 |
| NaOH g/l | 25 | 25 | 25 | 30 |
| $Pb(NO_3)_2$ g/l | 0.003 | 0.003 | 0.003 | 0.003 |
| $Cd(OEs)_2$ g/l | 0.0024 | 0.0024 | 0.0024 | 0.0024 |
| Thiourea g/l | 0.0016 | 0.0016 | 0.0016 | 0.0016 |

$NH_3$ q.s to ph 4.8

Notes:

1. The nickel sulfate solution was prepared using nickel sulfate crystals (333 g/l); the final concentration of $Ni^{+2}$ was 75 g/l. To this solution was added 0.030 g/l cadmium ethanesulfonate, $Cd(OEs)_2$, and 0.020 g/l thiourea. From this stock solution, 80 ml/l was added on make-up of Solution A.
2. The nickel methanesulfonate solution, Solution B, was prepared by dissolving 150 gm of nickel carbonate into approximately 360 ml of 70% methanesulfonic acid and water so the final concentration of $Ni^{+2}$ was 75 g/l. To this solution was added 0.030 g/l cadmium ethanesulfonate, $Cd(OEs)_2$, and 0.020 g/l thiourea. From this stock solution, 80 ml/l was added on make-up of Solution B.
3. The nickel hypophosphite solution, Solution C, was prepared by dissolving 70 gms nickel carbonate into 156 ml of a 50% hypophosphorus acid solution followed by dilution to one liter. The final concentration of $Ni^{+2}$ was 35 g/l and $H_2PO_2^-$ was 78 g/l. To this solution was added 0.014 g/l cadmium ethanesulfonate, $Cd(OEs)_2$, and 0.009 g/l thiourea. A total of 171 ml/l of this stock solution was added to make the electroless nickel solution.
4. The mixed counter-ion solution, Solution D, was prepared as in Note 3. To this solution was added 14.4 ml/l methanesulfonic acid.
5. The reducing agent, hypophosphite ($H_2PO_2^-$) was added as the acid, hypophosphorus acid. The addition of 44 ml/l of a 50% solution yielded 22 g/l as $H_2PO_2^-$ (30 g/l as $NaH_2PO_2$).
6. A calcium hypophosphite solution was prepared by dissolving 75 g calcium carbonate, $CaCO_3$, into 196 ml of a 50% hypophosphorus acid followed by dilution to one liter. This gave a final $Ca^{+2}$ concentration of 30 g/l and $H_2PO_2^-$ as 97.5 g/l.
7. A stock solution of thiourea was prepared containing 1 g/l.
8. A stock solution of cadmium ethanesulfonate was prepared containing 14 g/l.

-continued

| | Solution 2A | Solution 2B | Solution 2C | Solution 2D |
|---|---|---|---|---|

9. A stock solution of lead nitrate solution was prepared containing 11.2 g/l.
10. The pH of all solutions was 4.8–4.95 and the operating temperature was held between 89–92° C.
11. A stock solution of Ca(MSA)2 was prepared by dissolving 150 g/l $CaCO_3$ into 400 ml methanesulfonic acid. The solution was filtered giving a final concentration of 60 g/l as $Ca^{+2}$ and 286 g/l methanesulfonate.

Using these solutions studies were conducted on replenishment and removal of orthophosphite ($H_2PO_3^-$)

EXAMPLE 2A

NiSulfate Solution

Steel coupons were cleaned in a mild alkaline cleaner followed by immersion activation in 10% hydrochloric acid solution, room temperature for five seconds. The coupons were weighed before and after plating in Solution A.

Coupon #1 weight before plating—7.9243 gms.

Weight after plating—10.028 gms.

Total weight of deposit—2.1037 gms.

(Represents about one-third of a metal turnover)

With no coupon in solution, added 26 ml of stock nickel sulfate solution, 1.87 ml stock thiourea solution, 0.30 ml stock cadmium ethanesulfonate solution, 0.30 ml stock lead nitrate solution, 75 ml stock calcium hypophosphite solution and 5 ml ammonium hydroxide. Let solution mix for thirty minutes then filtered. Reheated solution to 90 C.

Coupon #2 weight before plating—8.0211 gms.

weight after plating—10.0728 gms.

Total weight of deposit—2.0517 gms.

(Represents about one-third of a metal turnover)

With no coupon in solution, added 26 ml of stock nickel sulfate solution, 1.87 ml stock thiourea solution, 0.30 ml stock cadmium ethanesulfonate solution, 0.30 ml stock lead nitrate solution, 75 ml stock calcium hypophosphite solution and 5 ml ammonium hydroxide. Let solution mix for thirty minutes then filtered. Reheated solution to 91° C.

Coupon #3 weight before plating—7.9461 gms.

weight after plating—10.0377 gms.

Total weight of deposit—2.0916 gms.

(Represents about one-third of a metal turnover)

With no coupon in solution, added 26 ml of stock nickel sulfate solution, 1.87 ml stock thiourea solution, 0.30 ml stock cadmium ethanesulfonate solution, 0.30 ml stock lead nitrate solution, 75 ml stock calcium hypophosphite solution and 5 ml ammonium hydroxide. Let solution mix for thirty minutes then filtered.

After three coupons, approximately 6 g/l $Ni^{+2}$ was plated from solution representing one metal turnover. The total amount of calcium hypophosphite added after the three coupons was 225 ml/l. Therefore, 6.75 g/l of $Ca^{+2}$ (0.17 M) and 22 g/l of $H_2PO_2^-$ was added. Analysis for hypophosphite ($H_2PO_2^-$) and orthophosphite ($H_2PO_3^-$) was done using a standard iodine and thiosulfate procedure. Analysis showed the electroless nickel solution contained 23.8 g/l $H_2PO_2^-$ and 14.7 g/l $H_2PO_3^-$. For one metal turnover, approximately 27 g/l of $H_2PO_3^-$ (0.33 M) are formed in solution Therefore, enough calcium was added from the calcium hypophosphite stock solution to theoretically precipitate all the $H_2PO_3^-$ from solution. However, a fraction of the calcium must have reacted with the sulfate since there is still a considerable amount of $H_2PO_3^-$ in solution.

EXAMPLE 2B

NiMSA Solution

Steel coupons were cleaned in a mild alkaline cleaner followed by immersion activation in 10% hydrochloric acid solution, room temperature for five seconds. The coupons were weighed before and after plating in Solution B.

Coupon #1 weight before plating—7.8244 gms.

weight after plating—9.8002 gms.

Total weight of deposit—1.9758 gms.

(Represents about one-third of a metal turnover)

With no coupon in solution, added 26 ml of stock nickel methanesulfonate solution, 1.87 ml stock thiourea solution, 0.30 ml stock cadmium ethanesulfonate solution, 0.30 ml stock lead nitrate solution, 75 ml stock calcium hypophosphite solution and 5 ml ammonium hydroxide. Let solution mix for thirty minutes then filtered. Reheated solution to about 90° C.

Coupon #2 weight before plating—8.2246 gms.

weight after plating—10.3369 gms.

Total weight of deposit—2.1123 gms.

(Represents about one-third of a metal turnover)

With no coupon in solution, added 26 ml of stock nickel methanesulfonate solution, 1.87 ml stock thiourea solution, 0.30 ml stock cadmium ethanesulfonate solution, 0.30 ml stock lead nitrate solution, 75 ml stock calcium hypophosphite solution and 5 ml ammonium hydroxide. Let solution mix for thirty minutes then filtered. Reheated solution to about 90° C.

Coupon #3 weight before plating—7.8562 gms.

weight after plating—9.7808 gms.

Total weight of deposit—1.9246 gms.

(Represents about one-third of a metal turnover)

With no coupon in solution, added 26 ml of stock nickel methanesulfonate solution, 1.87 ml stock thiourea solution, 0.30 ml stock cadmium ethanesulfonate solution, 0.30 ml stock lead nitrate solution, 75 ml stock calcium hypophosphite solution and 5 ml ammonium hydroxide. Let solution mix for thirty minutes then filtered.

After three coupons, approximately 6 g/l $Ni^{+2}$ was plated from solution representing one metal turnover. The total amount of calcium hypophosphite added after the three coupons was 225 ml/l. Therefore, 6.75 g/l of $Ca^{+2}$ (0.17 M) and 22 g/l of $H_2PO_2^-$ was added. Analysis for hypophosphite ($H_2PO_2^-$) and orthophosphite ($H_2PO_3^-$) was done using a standard iodine and thiosulfate procedure. Analysis showed the electroless nickel solution contained 21.3 g/l $H_2PO_2^-$ and 1.4 g/l $H_2PO_3^-$. For one metal turnover, approximately 27 g/l of $H_2PO_3^-$ (0.33 M) are formed in solution Therefore, enough calcium was added from the calcium hypophosphite stock solution to theoretically precipitate all the $H_2PO_3^-$ from solution. It appears that most of the calcium reacted with the orthophosphite and the phosphite was removed from solution via filtration.

EXAMPLE 2C

NiHypophosphite Solution

Steel coupons were cleaned in a mild alkaline cleaner followed by immersion activation in 10% hydrochloric acid solution, room temperature for five seconds. The coupons were weighed before and after plating in Solution C.

Coupon #1 weight before plating—7.9246 gms.

weight after plating—10.1349 gms.

Total weight of deposit—2.2103 gms.

(Represents about one-third of a metal turnover)

With no coupon in solution, added 57 ml of stock nickel hypophosphite solution, 1.90 ml stock thiourea solution, 0.28 ml stock cadmium ethanesulfonate solution, 0.34 ml stock lead nitrate solution, 30 ml/l $Ca(H_2PO_2)_2$, 2 g/l sodium hydroxide and 5 ml ammonium hydroxide. Let solution mix for thirty minutes then filtered. Reheated solution to about 90° C.

Coupon #2 weight before plating—8.1278 gms.

weight after plating—10.0821 gms.

Total weight of deposit—1.9543 gms.

(Represents about one-third of a metal turnover)

With no coupon in solution, added 57 ml of stock nickel hypophosphite solution, 1.90 ml stock thiourea solution, 0.28 ml stock cadmium ethanesulfonate solution, 0.34 ml stock lead nitrate solution, 30 ml/l $Ca(H_2PO_2)_2$, 2 g/l sodium hydroxide and 5 ml ammonium hydroxide. Let solution mix for thirty minutes then filtered. Reheated solution to about 90° C.

Coupon #3 weight before plating—8.0566 gms.

weight after plating—10.1354 gms.

Total weight of deposit—2.0788 gms.

(Represents about one-third of a metal turnover)

With no coupon in solution, added 57 ml of stock nickel hypophosphite solution, 1.90 ml stock thiourea solution, 0.28 ml stock cadmium ethanesulfonate solution, 0.34 ml stock lead nitrate solution, 30 ml/l $Ca(H_2PO_2)_2$, 2 g/l sodium hydroxide and 5 ml ammonium hydroxide. Let solution mix for thirty minutes then filtered. Reheated solution to about 90° C.

After three coupons, approximately 6 g/l $Ni^{+2}$ was plated from solution representing one metal turnover. A total of 90 ml of the stock $Ca(H_2PO_2)_2$ solution was added to the nickel hypophosphite solution. Analysis showed the hypophosphite concentration was 24.2 g/l and orthophosphite was 18 g/l. The total amount of calcium added was 2.7 g/l as $Ca^{+2}$ (0.067 M). For one metal turnover, approximately 27 g/l of $H_2PO_3^-$ (0.33 M) are formed in solution Therefore, insufficient calcium was added from the calcium hypophosphite stock solution to theoretically precipitate all the $H_2PO_3^-$ from solution. It appears that all of the calcium reacted with the orthophosphite and a fraction of the phosphite was removed from solution via filtration.

EXAMPLE 2D

NiHypophosphite Solution+Methanesulfonic Acid

Steel coupons were cleaned in a mild alkaline cleaner followed by immersion activation in 10% hydrochloric acid solution, room temperature for five seconds. The coupons were weighed before and after plating in Solution C.

Coupon #1 weight before plating—8.1342 gms.

weight after plating—10.2652 gms.

Total weight of deposit—2.1310 gms.

(Represents about one third of a metal turnover)

With no coupon in solution, added 57 ml of stock nickel hypophosphite solution, 1.90 ml stock thiourea solution, 0.28 ml stock cadmium ethanesulfonate solution, 0.34 ml stock lead nitrate solution, 30 ml/l $Ca(H_2PO_2)_2$, 2 g/l sodium hydroxide and 5 ml ammonium hydroxide. Let solution mix for thirty minutes then filtered. Reheated solution to about 90° C.

Coupon #2 weight before plating—7.8975 gms.

weight after plating—9.9918 gms.

Total weight of deposit—2.0943 gms.

(Represents about one-third of a metal turnover)

With no coupon in solution, added 57 ml of stock nickel hypophosphite solution, 1.90 ml stock thiourea solution, 0.28 ml stock cadmium ethanesulfonate solution, 0.34 ml stock lead nitrate solution, 30 ml/l $Ca(H_2PO_2)_2$, 2 g/l sodium hydroxide and 5 ml ammonium hydroxide. Let solution mix for thirty minutes then filtered. Reheated solution to about 90° C.

Coupon #3 weight before plating—8.0784 gms.

weight after plating—10.2049 gms.

Total weight of deposit—2.1265 gms.

(Represents about one-third of a metal turnover)

With no coupon in solution, added 57 ml of stock nickel hypophosphite solution, 1.90 ml stock thiourea solution, 0.28 ml stock cadmium ethanesulfonate solution, 0.34 ml stock lead nitrate solution, 30 ml/l $Ca(H_2PO_2)_2$, 2 g/l sodium hydroxide and 5 ml ammonium hydroxide. Let solution mix for thirty minutes then filtered. Reheated solution to about 90° C.

After three coupons, approximately 6 g/l $Ni^{+2}$ was plated from solution representing one metal turnover. A total of 90 ml of the stock $Ca(H_2PO_2)_2$ solution was added to the nickel hypophosphite solution. Analysis showed the hypophosphite concentration was 22.9 g/l and orthophosphite was 17 g/l. The total amount of calcium added was 2.7 g/l as $Ca^{+2}$ (0.067 M). For one metal turnover, approximately 27 g/l of $H_2PO_3^-$ (0.33 M) are formed in solution Therefore, insufficient calcium was added from the calcium hypophosphite stock solution to theoretically precipitate all the $H_2PO_3^-$ from solution. However, it appears that all of the calcium reacted with the orthophosphite and a fraction of the phosphite was removed from solution via filtration.

EXAMPLE 3

In-Situ Removal of Orthophosphite

This study shows the calcium addition preferably is done off-line in a separate plating tank or is done in the main plating tank only if there is no substrate in the plating tank.

Solution 2B above(nickel methanesulfonate) was used in this study. After plating to two metal-turnovers with ongoing replenishments, the solution was analyzed for hypophosphite and orthophosphite. The operating solution contained 23.5 g/l as $H_2PO_2^-$ and 57 g/l as $H_2PO_3^-$. While a piece of low carbon steel was immersed in the electroless nickel solution and being coated with the nickel-phosphorus deposit, 50 ml/l of the stock calcium methanesulfonate solution was slowly added to the operating solution. A white precipitate was seen floating in the solution. After plating for thirty minutes, the steel coupon was removed from the electroless nickel solution, dried and examined in a scanning electron microscope. The deposit surface was rough with large nodular and irregular protrusion. Elemental analysis showed these rough regions were high in calcium and phosphorus. It is likely these large protrusions are occluded calcium phosphite. Therefore, the in-situ method of removing the phosphite does not appear to be the preferred method of the invention. The precipitation of phosphite preferably should occur when there is no plating occurring in the plating tank or it must be done off-line in a separate tank. Excess calcium in the electrolness nickel solution is not desired because of the spontaneous precipitation of orthophosphite. It is desired to have slight excess phosphite, 0.05–2.0 M $H_2PO_3^-$ because these concentrations do not have a detrimental effect on the properties of the electroless nickel coating.

While the invention has been described in the context of nickel deposits, it is possible to deposit other metals to form phosphorous alloys; such metals include iron, cobalt tungsten, titanium and boron.

What is claimed is:

1. A non-sulfate containing electroless nickel bath consisting essentially of a) hypophosphite ion, b) nickel ion, c) alkali metal or alkaline earth metal ion, d) an ion derived from an alkyl sulfonic acid, the ion of the formula:

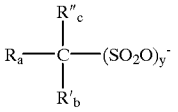

where:

a, b and c each independently is an integer from 1 to 3;

y is an integer from 1 to 3;

R" is hydrogen, or lower alkyl that is unsubstituted or substituted by oxygen, Cl, F, Br or I, $CF_3$ or —$SO_2OH$;

R and R' each independently is hydrogen, Cl, F, Br, I; $CF_3$ or lower alkyl that is unsubstituted or substituted by oxygen, Cl, F, Br, 1, $CF_3$ or —$SO_2OH$;

and the sum of a+b+c+y=4; and e) optionally, buffers, stabilizers, complexing agents, chelating agents, accelerators, inhibitors or brighteners, wherein the alkali metal or alkaline earth metal ion is calcium introduced as a salt with the hypophosphite ion or sulfonic acid ion.

2. The composition of claim 1 wherein the alkyl sulfonic acid is an alkyl monosulfonic acid or an alkyl polysulfonic acid.

3. The composition of claim 1 wherein the alkyl sulfonic acid is methanesulfonic acid, ethanesulfonic acid, propanesulfonic acid, methanedisulfonic acid, monochloromethanedisulfonic acid, dichloromethanedisulfonic acid, 1,1-ethanedisulfonic acid, 2-chloro-1,1-ethanedisulfonic acid, 1,2-dichloro-1,1-ethanedisulfonic acid, 1,1-propanedisulfonic acid, 3-chloro-1,1-propanedisulfonic acid, 1,2-ethylene disulfonic acid or 1,3-propylene disulfonic acid.

4. The composition of claim 1 wherein the alkyl sulfonic acid is methanesulfonic acid or methanedisulfonic acid.

5. The composition of claim 1 wherein the nickel ion is introduced as salt of hypophosphite or alkyl sulfonic acid.

6. An improvement in an electroless nickel bath which has been used to plate a substrate, wherein the substrate is no longer within the bath, the bath consisting essentially of:

a) hypophosphite ion, b) orthophosphite ion, c) nickel ion, and d) an ion derived from an alkyl sulfonic acid, the ion of the formula:

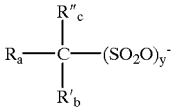

where:

a, b and c each independently is an integer from 1 to 3;

y is an integer from 1 to 3;

R" is hydrogen, or lower alkyl that is unsubstituted or substituted by oxygen, Cl, F, Br or I, $CF_3$, or —$SO_2OH$;

R and R' each independently is hydrogen, Cl, F, Br, 1; $CF_3$ or lower alkyl that is unsubstituted or substituted by oxygen, Cl, F, Br, I, $CF_3$ or —$S(O)_2OH$, and the sum of a+b+c+y=4; and e) optionally, buffers, stabilizers, complexing agents, chelating agents, accelerators, inhibitors or brighteners, the improvement comprising an additional component in the bath, the additional component being an alkali metal or alkaline earth metal ion in less than a stoichiometric amount compared to the orthophosphite ion, wherein the alkali metal or alkaline earth metal ion forms an insoluble salt with the orthophosphite ion, wherein the alkali metal or alkaline earth metal ion is calcium introduced as a salt with the hypophosphite ion or sulfonic acid ion.

7. The composition of claim 6 wherein the alkyl sulfonic acid is an alkyl monosulfonic acid or an alkyl polysulfonic acid.

8. The composition of claim 6 wherein the alkyl sulfonic acid is methanesulfonic acid or methanedisulfonic acid.

9. An improvement in a process utilizing an electroless nickel bath employing a hypophosphite reducing agent and operated under electroless nickel conditions, wherein orthophosphite is produced, the improvement comprising, adding a soluble alkali metal or alkaline earth metal compound to the bath wherein the alkali metal or alkaline earth metal ion is calcium introduced as a salt of hypophosphite acid or an sulfonic acid;

forming an insoluble calcium orthophosphite during the electroless nickel reaction;

and removing the insoluble orthophosphite from the bath.

10. The process of claim 9 wherein the insoluble orthophosphite is removed from the bath using filtration or separation procedures.

11. The process of claim 9 wherein the soluble alkali metal or alkaline earth metal compound is an hypophosphite or methanesulfonate salt.

12. An improvement in a process utilizing an electroless nickel bath employing a hypophosphite reducing agent and operated under electroless nickel conditions, the improvement process comprising:

adding a calcium hypophosphite to the bath during the electroless nickel reaction;

forming an insoluble calcium orthophosphite;

and removing the insoluble calcium orthophosphite from the bath.

13. The improvement of claim 12, the improvement comprising:

adding calcium methanesulfonate and calcium hypophosphite to the bath during the electroless nickel reaction;

forming an insoluble calcium orthophosphite;

and removing the insoluble calcium orthophosphite from the bath.

14. A process which utilizes an electroless nickel bath employing a hypophosphite reducing agent and a mixed nickel salt of an alkyl sulfonic acid and hypophosphorous acid, acetic acid, sulfamic acid, lactic acid, formic acid, propionic acid or mixtures thereof, wherein orthophosphite is produced under electroless conditions, the process further comprising:

adding calcium methanesulfonate or calcium hypophosphite to the bath during or after the electroless nickel reaction;

forming an insoluble calcium orthophosphite;

and removing the insoluble calcium orthophosphite from the bath.

15. An improvement in a process utilizing an electroless nickel bath employing a hypophosphite reducing agent and operated under electroless nickel conditions to plate nickel onto a substrate, wherein the process produces orthophosphite; the improvement comprising:

adding a less than stoichiometric amount, compared to the orthophosphite, calcium methanesulfonate or calcium hypophosphite to the bath during a period when no electroless nickel reaction is occurring;

forming an insoluble calcium orthophosphite;

and removing the insoluble calcium orthophosphite from the bath.

16. An improvement in a process comprising using an electroless nickel bath to plate a substrate, the bath comprising:

a) hypophosphite ion, b) orthophosphite ion, c) nickel ion, d) alkali metal or alkaline earth metal ion in less than a stoichiometric amount compared to the orthophosphite ion and, wherein the alkali metal or alkaline earth metal ion forms an insoluble salt with the orthophospite ion, and e) an ion derived from an alkyl sulfonic acid, the ion of the formula:

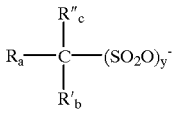

where:

a, b and c each independently is an integer from 1 to 3;

y is an integer from 1 to 3;

R" is hydrogen, or lower alkyl that is unsubstituted or substituted by oxygen, Cl, F, Br or I, $CF_3$ or $—SO_2OH$;

R and R' each independently is hydrogen, Cl, F, Br, I; $CF_3$ or lower alkyl that is unsubstituted or substituted by oxygen, Cl, F, Br, I, $CF_3$ or $—SO_2OH$;

and the sum of a+b+c+y=4; and f) optionally, buffers, stabilizers, complexing agents, chelating agents, accelerators, inhibitors or brighteners, the improvement comprising, removing the substrate from the bath;

adding a less than stoichiometric amount, compared to the orthophosphite, of calcium methanesulfonate or calcium hypophosphite to the bath during a period when no electroless nickel reaction is occurring;

forming an insoluble calcium orthophosphite;

and removing the insoluble calcium orthophosphite from the bath.

* * * * *